US009577315B2

(12) United States Patent
Li et al.

(10) Patent No.: US 9,577,315 B2
(45) Date of Patent: Feb. 21, 2017

(54) ANTENNAS MOUNTED UNDER DIELECTRIC PLATES

(71) Applicant: Apple Inc., Cupertino, CA (US)

(72) Inventors: Qingxiang Li, Mountain View, CA (US); Robert W. Schlub, Cupertino, CA (US); Fletcher R. Rothkopf, Los Altos, CA (US); Adam D. Mittleman, San Francisco, CA (US); Yi Jiang, Sunnyvale, CA (US); Emily McMilin, Mountain View, CA (US); Li-jun Zhang, San Jose, CA (US)

(73) Assignee: Apple Inc., Cupertino, CA (US)

( * ) Notice: Subject to any disclaimer, the term of this patent is extended or adjusted under 35 U.S.C. 154(b) by 194 days.

(21) Appl. No.: 14/306,121

(22) Filed: Jun. 16, 2014

(65) Prior Publication Data

US 2014/0292591 A1 Oct. 2, 2014

Related U.S. Application Data

(63) Continuation of application No. 12/870,766, filed on Aug. 27, 2010, now Pat. No. 8,766,858.

(51) Int. Cl.
*H01Q 1/24* (2006.01)
*H01Q 1/00* (2006.01)
(Continued)

(52) U.S. Cl.
CPC ..... *H01Q 1/24* (2013.01); *H01Q 1/2266* (2013.01); *H01Q 1/243* (2013.01); *H01Q 1/38* (2013.01);
(Continued)

(58) Field of Classification Search
CPC ..... H05K 9/0022; H01Q 1/243
See application file for complete search history.

(56) References Cited

U.S. PATENT DOCUMENTS 5,768,217 A * 6/1998 Sonoda ..... G04B 47/025 343/718
5,872,557 A 2/1999 Wiemer et al.
(Continued)

FOREIGN PATENT DOCUMENTS

CN 101068056 11/2007
CN 101276239 10/2008
(Continued)

OTHER PUBLICATIONS

DOTITE: The wiring for printed circuit boards, electrodes, and contact materials (http://www.fkkasei.co.jp/english/product/electric/dotite/02.html) Retrieved on Jun. 17, 2016.*
(Continued)

*Primary Examiner* — Dameon E Levi
*Assistant Examiner* — Ricardo Magallanes
(74) *Attorney, Agent, or Firm* — Treyz Law Group, P.C.; G. Victor Treyz; Zachary D. Hadd

(57) ABSTRACT

Electronic devices are provided that contain wireless communications circuitry. The wireless communications circuitry may include radio-frequency transceiver circuitry and antenna structures. The antenna structures may include antennas such as inverted-F antennas that contain antenna resonating elements and antenna ground elements. Antenna resonating elements may be formed from patterned conductive traces on substrates such as flex circuit substrates. Antenna ground elements may be formed from conductive device structures such as metal housing walls. Support and biasing structures such as dielectric support members and layer of foam may be used to support and bias antenna resonating elements against planar device structures. The planar device structures against which the antenna resonating elements are biased may be planar dielectric members such as transparent layers of display cover glass or other
(Continued)

planar structures. Adhesive may be interposed between the planar structures and the antenna resonating elements.

14 Claims, 17 Drawing Sheets

(51) Int. Cl.

| | |
|---|---|
| ***H01Q 1/42*** | (2006.01) |
| ***H01R 12/00*** | (2006.01) |
| ***H01Q 1/44*** | (2006.01) |
| ***H01Q 1/22*** | (2006.01) |
| ***H01Q 1/38*** | (2006.01) |
| ***H01Q 1/48*** | (2006.01) |
| ***H01Q 9/04*** | (2006.01) |
| ***H01Q 9/42*** | (2006.01) |

(52) U.S. Cl.
CPC ..... *H01Q 1/44* (2013.01); *H01Q 1/48* (2013.01); *H01Q 9/0421* (2013.01); *H01Q 9/42* (2013.01)

(56) References Cited

U.S. PATENT DOCUMENTS

| | | | | |
|---|---|---|---|---|
| 6,344,825 | B1 | 2/2002 | Wong | |
| 6,642,892 | B2 | 11/2003 | Masaki et al. | |
| 6,985,361 | B2 | 1/2006 | Credelle et al. | |
| 7,075,782 | B2 | 7/2006 | Teshima | |
| 7,256,743 | B2 | 8/2007 | Korva | |
| 7,322,833 | B1 * | 1/2008 | Hakansson | H01Q 1/38 439/67 |
| 7,579,993 | B2 | 8/2009 | Lev et al. | |
| 7,710,331 | B2 | 5/2010 | Schillmeier et al. | |
| 8,638,549 | B2 | 1/2014 | Garelli et al. | |
| 2003/0001780 | A1 | 1/2003 | Hill et al. | |
| 2003/0197648 | A1 | 10/2003 | Quinn et al. | |
| 2005/0200535 | A1 | 9/2005 | Elkobi et al. | |
| 2006/0227053 | A1 | 10/2006 | Ishikura | |
| 2007/0202933 | A1 | 8/2007 | Tolbert et al. | |
| 2007/0262090 | A1 | 11/2007 | Ritsche | |
| 2007/0296592 | A1 | 12/2007 | Huang et al. | |
| 2008/0316117 | A1 | 12/2008 | Hill et al. | |
| 2009/0067141 | A1 * | 3/2009 | Dabov | H01Q 1/243 361/753 |
| 2009/0115683 | A1 | 5/2009 | Kurashima et al. | |
| 2009/0133825 | A1 | 5/2009 | Prat et al. | |
| 2009/0153412 | A1 * | 6/2009 | Chiang | H01Q 1/52 343/702 |
| 2009/0174612 | A1 | 7/2009 | Ayala et al. | |
| 2009/0265969 | A1 | 10/2009 | Nezu | |
| 2009/0295648 | A1 | 12/2009 | Dorsey et al. | |
| 2009/0315788 | A1 | 12/2009 | Hirota | |
| 2010/0073241 | A1 | 3/2010 | Ayala et al. | |
| 2010/0201582 | A1 | 8/2010 | Nam et al. | |
| 2010/0321253 | A1 | 12/2010 | Ayala Vazquez et al. | |
| 2010/0321325 | A1 | 12/2010 | Springer et al. | |
| 2011/0006953 | A1 | 1/2011 | Chiang et al. | |
| 2011/0025575 | A1 | 2/2011 | Niederkorn et al. | |
| 2011/0188179 | A1 | 8/2011 | Myers et al. | |
| 2011/0254745 | A1 | 10/2011 | Tsujimura et al. | |

FOREIGN PATENT DOCUMENTS

| | | |
|---|---|---|
| EP | 0543645 | 5/1993 |
| EP | 1868263 | 12/2007 |
| EP | 2110882 | 10/2009 |
| EP | 2128924 | 12/2009 |
| GB | 2437838 | 11/2007 |
| JP | 2003280815 | 10/2003 |
| JP | 2006048166 | 2/2006 |
| JP | 2007266822 | 10/2007 |
| JP | 2008306552 | 12/2008 |
| JP | 200935523 | 2/2009 |
| JP | 200965388 | 3/2009 |
| JP | 2009118027 | 5/2009 |
| JP | 2009290270 | 12/2009 |
| JP | 201010822 | 1/2010 |
| KR | 10-2007-0016731 | 2/2007 |
| KR | 10-2010-0062539 | 6/2010 |
| WO | 2007083500 | 7/2007 |

OTHER PUBLICATIONS

Office Action dated Jan. 20, 2014 in Japanese Patent Application 2013-524849.

* cited by examiner

ANTENNAS MOUNTED UNDER DIELECTRIC PLATES

This application is a continuation of U.S. patent application Ser. No. 12/870,766, filed Aug. 27, 2010, which is hereby incorporated by reference herein in its entirety. This application claims the benefit of and claims priority to U.S. patent application Ser. No. 12/870,766, filed Aug. 27, 2010.

BACKGROUND

This relates generally to wireless communications, and, more particularly, to wireless electronic devices and antenna structures for wireless electronic devices.

Electronic devices such as cellular telephones, portable music players, and computers contain wireless communications circuitry. For example, electronic devices may have antennas for handling wireless communications in cellular telephone bands and communications bands associated with wireless local area networks.

To satisfy consumer demand for small form factor wireless devices, manufacturers are continually striving to implement wireless communications circuitry such as antenna components using compact structures. At the same time, it may be desirable to include conductive structures in an electronic device such as metal device housing components. Because conductive components can affect radio-frequency performance, care must be taken when incorporating antennas into an electronic device that includes conductive structures.

It would therefore be desirable to be able to provide improved ways in which to incorporate antennas into electronic devices.

SUMMARY

Electronic devices may be provided with wireless communications circuitry. The wireless communications circuitry may include radio-frequency transceiver circuitry and antenna structures. The antenna structures may include antennas such as inverted-F antennas that contain antenna resonating elements and antenna ground elements.

Antenna resonating elements may be formed from patterned conductive traces on substrates such as flex circuit substrates. Antenna ground elements may be formed from conductive device structures such as metal housing walls. Radio-frequency transceiver circuits, displays, and other device components may be mounted within the metal housing walls.

A display may have a rectangular outline. The outermost layer of the display may be formed from a transparent rectangular display member such as a layer of cover glass. An array of image pixel elements may be used to display an image on the display through the layer of cover glass. The image may be displayed in an active portion of the display such as a central rectangular region. Peripheral portions of the display such as the edges of the transparent rectangular display member may be inactive. A layer of opaque masking material such as a layer of patterned black ink may be provided on the underside of the transparent rectangular display member to block interior device components from view.

Antenna structures may be mounted in a device so that radio-frequency signals can be transmitted and received through planar dielectric structures. The planar dielectric structures may be housing structures such as dielectric housing plates. The planar dielectric structures may also be associated with display structures. For example, the planar dielectric structures may be transparent rectangular display members. An antenna that is formed from an antenna resonating element and an antenna ground that is formed from metal housing walls may, for example, be mounted on the interior surface of a transparent rectangular display member. The antenna may be mounted in the inactive portion of the display, so that the antenna resonating element is located under the opaque masking layer.

An antenna resonating element may be mounted in an electronic device using support and biasing structures. The support and biasing structures may include dielectric support members such as polymer support structures. The support and biasing structures may also include flexible structures that force the antenna resonating element against the inner surface of the transparent display member. The biasing structures may be formed from foam or other structures that impart outwards force on the antenna resonating element.

A layer of adhesive may be interposed between an antenna resonating element and the inner surface of a display cover glass or other planar dielectric member. The layer of adhesive may be used to attach the antenna resonating element to the display cover glass or other dielectric member.

An antenna in an electronic device may have a conductive cavity. The conductive cavity may be formed from a metal can or other conductive structure. Support and biasing structures may be used to force the edges of the conductive cavity against the inner surface of a planar dielectric member.

Further features of the invention, its nature and various advantages will be more apparent from the accompanying drawings and the following detailed description of the preferred embodiments.

DETAILED DESCRIPTION

Electronic devices may be provided with wireless communications circuitry. The wireless communications circuitry may be used, to support wireless communications in one or more wireless communications bands such as cellular telephone bands, satellite navigation bands, and local wireless area network bands (e.g., 2.4 GHz and 5 GHz to support IEEE 802.11 communications or 2.4 GHz to support Bluetooth® communications). Other wireless communications bands may also be supported.

The wireless communications circuitry may include one or more antennas. The antennas may be based on antenna structures such as patch antennas, monopole antenna structures, dipoles, loop antennas, closed slot antennas, open slot antennas, planar inverted-F antennas, inverted-F antennas, hybrid antennas that include more than one antennas of these types, and other antenna structures.

To ensure that the antennas operate satisfactorily while being hidden from view, antenna structures may be mounted behind dielectric structures such as planar dielectric layers. In devices with displays, the displays may include one or more planar dielectric layers such as a cover glass layer, a polarizer layer, a color filter array layer, a thin-film transistor layer, etc. A device may also include one or more planar dielectric layers that are not associated with a display. For example, a device may include one or more planar dielectric housing structures.

Figure 1:
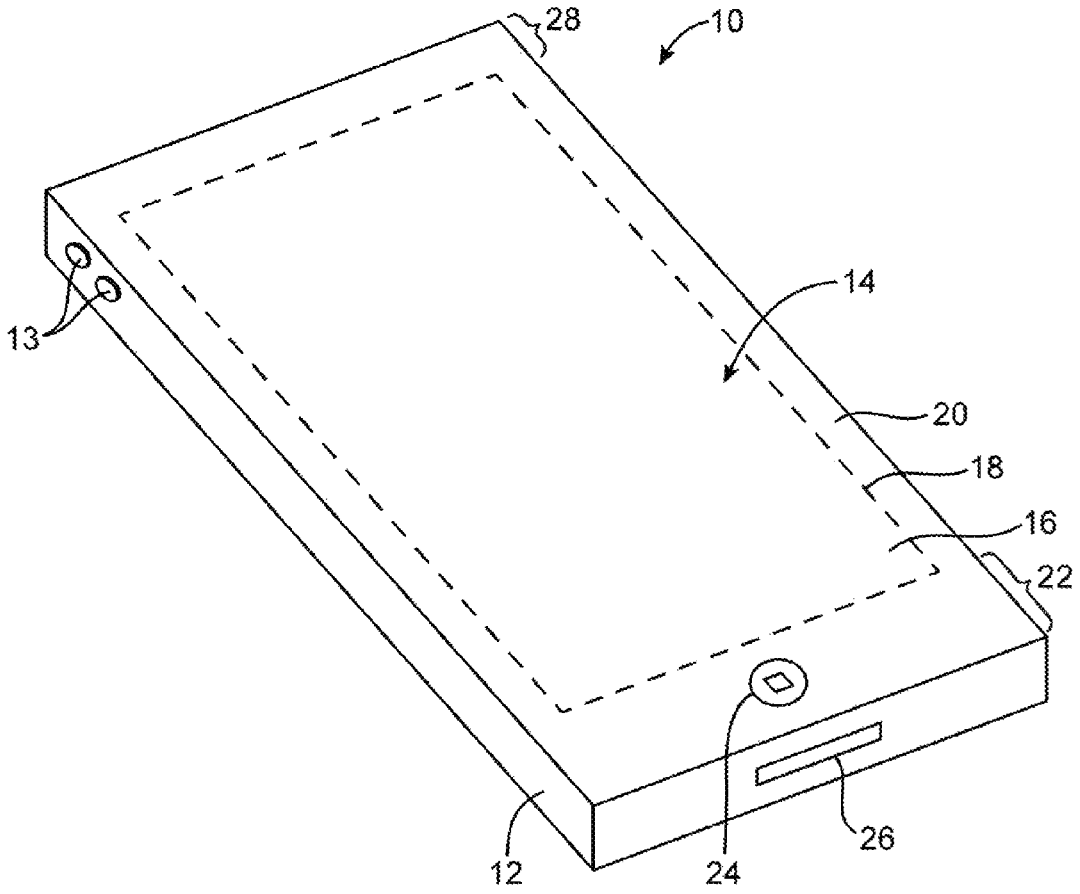
FIG. 1 is a perspective view of an illustrative electronic device such as a handheld electronic device with wireless communications circuitry in accordance with an embodiment of the present invention.

An illustrative electronic device such as a handheld electronic device in which one or more antennas may be mounted behind planar dielectric layer is shown in FIG. 1. Electronic device 10 of FIG. 1 may be, for example, a handheld electronic device such as a cellular telephone, media player, or gaming device (as examples).

Device 10 may include a housing such as housing 12. Housing 12 may be formed from plastic, metal, fiber composites such as carbon fiber, glass, ceramic, other materials, and combinations of these materials. Housing 12 may be formed using a unibody construction in which housing 12 is formed from an integrated piece of material or may be formed from frame structures, housing walls, and other components that are attached to each other using fasteners, adhesive, and other attachment mechanisms. In some situations, housing 12 may be formed from dielectrics such as plastic and glass. In other situations, housing 12 may be formed from conductive materials such as metal. Particularly in arrangements where housing 12 includes metal structures, care should be taken in locating antennas in device 10, because the metal of housing 12 may affect antenna performance.

Device 10 may have input-output devices such as a track pad or other touch sensitive devices, a keyboard, microphones, speakers, and other input-output devices. These devices may be used to gather user input and to supply a user with output. Ports such as port 26 may receive mating connectors (e.g., an audio plug, a connector associated with a data cable, etc.).

Device 10 may have buttons such as buttons 13 and 24. Buttons such as buttons 12 may be mounted in housing 12 (e.g., in a housing sidewall). Buttons such as button 24 may be mounted on the front face of device 10 (e.g., to serve as a menu button).

Device 10 may include a display such a display 14. Display 14 may be a liquid crystal display (LCD), a plasma display, an organic light-emitting diode (OLED) display, an electronic ink display, or a display implemented using other display technologies. A touch sensor may be incorporated into display 14 (i.e., display 14 may be a touch screen display). Touch sensors for display 14 may be resistive touch sensors, capacitive touch sensors, acoustic touch sensors, light-based touch sensors, force sensors, or touch sensors implemented using other touch technologies.

Display 14 may contain multiple layers. For example, display 14 may contain a backlight unit, optical films such as polarizers and birefringent films, a touch sensor array, a thin-film transistor layer, and a color filter array layer. The outermost layer of display 14 may be formed from one of these display layers (e.g., a color filter array layer or a polarizer layer) or may be formed from a protective cover layer. A protective cover layer for display 14 may, for example, be formed from a transparent cover plate such as a clear plastic plate or a layer of glass (sometimes referred to as a cover glass, cover glass layer, or cover glass plate).

In the illustrative arrangement of FIG. 1, display has an outermost layer (e.g., a cover glass layer) that extends over the front, surface of device 10. The central portion of display 14 may contain active images pixels for forming an image and may therefore sometimes be referred to as the active region of the display. The surrounding portions of display 14 do not contain image pixels and are therefore sometimes said to form an inactive region of the display. In the example of FIG. 1, rectangular dashed line 18 denotes the border between interior rectangular active region 16 and surrounding inactive region 20. Region 20 has a substantially rectangular ring shape formed by left, right, top, and bottom edge regions.

Active region 16 of display 14 may contain conductive structures such as touch sensor electrodes, transistors and interconnect lines associated, with a thin-film transistor array or other image pixel array, etc. Because conductors may affect the operation of the antennas in device 10, it may be desirable to locate antennas in device 10 at locations other than those immediately under active region 16 such as under top edge portion 28 of inactive region 20 or lower edge portion 22 of inactive region 20. Antennas may also be formed behind other portions of inactive display region 20 (e.g., to the left or right of active region 16).

When antennas are located under inactive display region 20, antenna signals may be transmitted and received through region 20 (i.e., portions of inactive region 20 such as upper rectangular region 28 at the top end of device 10 or lower rectangular region 22 at the lower end of device 10) and need not be conveyed through conductive structures such as conductive sidewalls and conductive planar rear wall structures in housing 12. If desired, device 10 may contain other planar dielectric structures. For example, the rear surface of device 10 (i.e., the surface opposing the front side that contains display 14) may be formed from a planar dielectric structure (e.g., a glass plate, a ceramic plate, etc.). Antennas may be formed under this type of rear plate or under other dielectric device structures.

Figure 2:
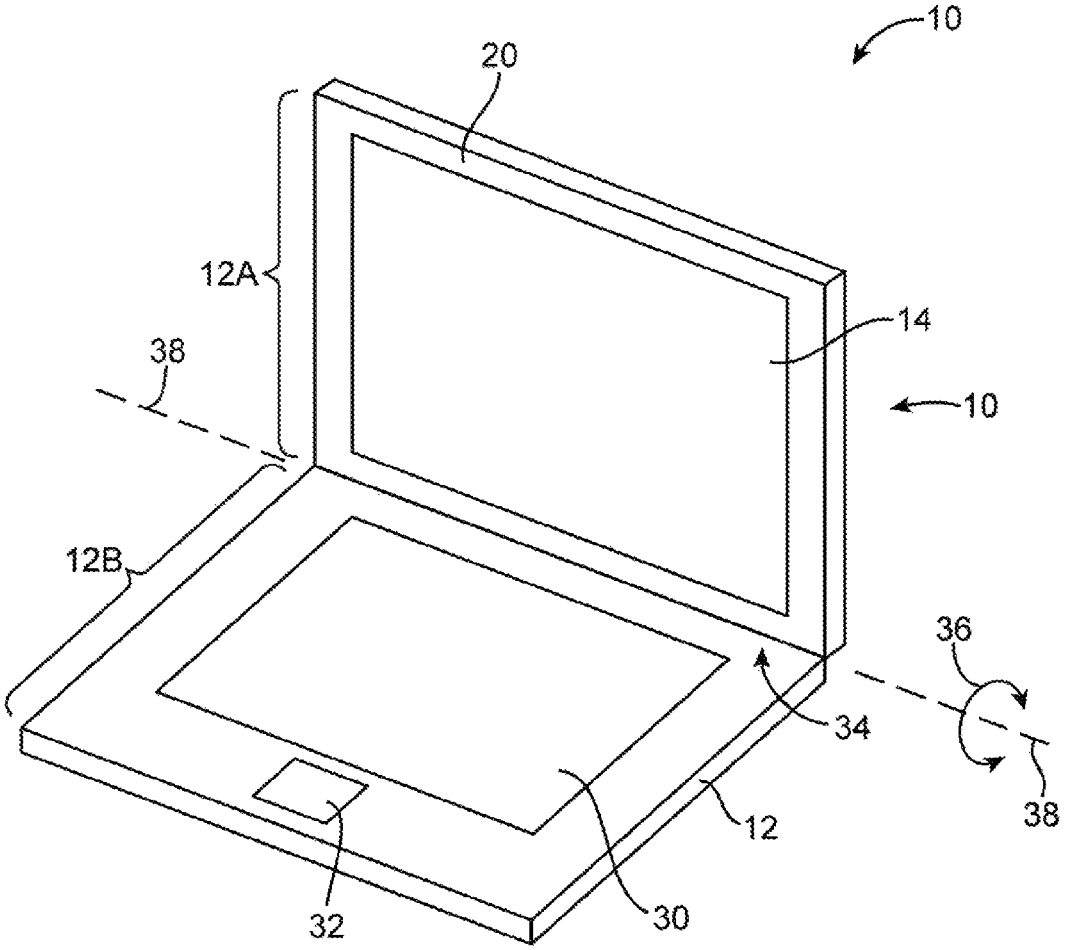
FIG. 2 is a perspective view of an illustrative electronic device such as a portable computer with wireless communications circuitry in accordance with an embodiment of the present invention.

As shown in FIG. 2, electronic device 10 may be a device such as a portable computer or other device that has a two-part housing formed from upper housing 12A and lower housing 12B. Upper housing 12A may include display 14 and may sometimes be referred to as a display housing. Lower housing 12B may sometimes be referred to as a base or main housing. Housings 12A and 128 may be connected to each other using a hinge (e.g., a hinge located along the upper edge of lower housing 12B and the lower edge of upper housing 12A). The hinge may allow upper housing 12A to rotate about axis 38 in directions 36 relative to lower housing 12B. Device 10 may include input-output components such as keyboard 30 and track pad 32.

Display 14 may be surrounded by inactive regions 20. Inactive regions 20 may be associated with portions of a cover glass layer or other dielectric layer that does not have underlying active image pixel elements. A cosmetic trim structure (e.g., a bezel formed from a dielectric such as plastic) may, if desired, be used to hide portions 20 from view. In configurations where it is desired to minimize the size of such trim structures, inactive portions may be formed as integral portions of a cover plate on display 14 (e.g., a rectangular ring portion of display 14 that surrounds a central active display region and forms a peripheral border for display 14). Antennas may be formed under inactive display portions 20 or other planar dielectric structures in device 10 of FIG. 2 (e.g., dielectric plates such as glass plates that are formed as part of housing 12, etc.).

Figure 3:
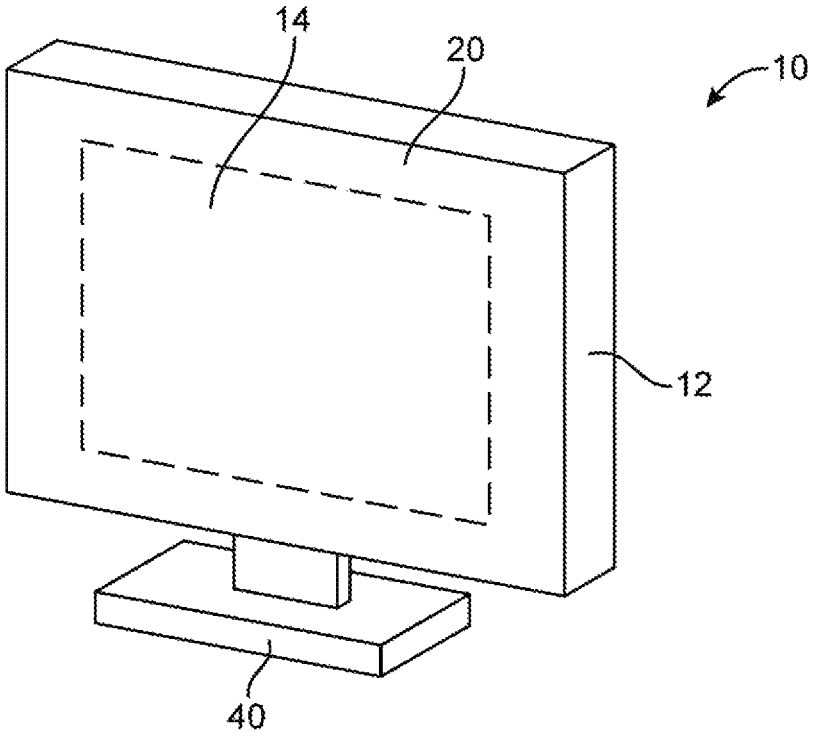
FIG. 3 is a perspective view of an illustrative electronic device that includes a display and wireless communications circuitry in accordance with an embodiment of the present invention.

As shown in FIG. 3, electronic device 10 may be a computer that is integrated into a computer monitor housing, may be a computer monitor, or may be a television. In this type of configuration, display 14 may be mounted on a support structure such as stand 40. Inactive border region of display 14 may be covered with a trim structure such as a bezel formed from plastic or other dielectric material or may be an uncovered peripheral portion of a display structure such as a layer of cover glass. Antennas may be formed under regions 20 at the edges of display 14 or may be formed behind other planar dielectric structures in device 10 of FIG. 3. As an example, housing 12 may have a planar dielectric structure such as a dielectric plate on Its rear surface. Antennas for device 10 may be formed under the surface of this type of dielectric plate if desired.

Figure 4:
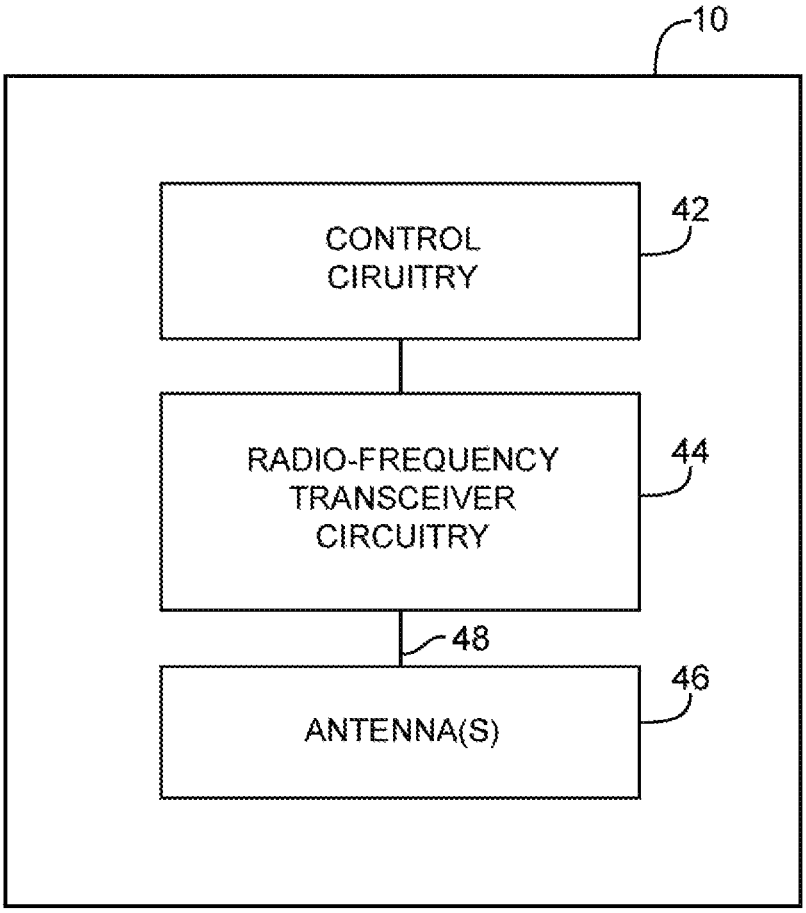
FIG. 4 is a schematic diagram of an illustrative electronic device with wireless communications circuitry in accordance with an embodiment of the present invention.

Illustrative circuitry that may be included in electronic device 10 (e.g., electronic devices of the types shown in FIGS. 1, 2, and 3 and other electronic equipment) is shown in FIG. 4. As shown in FIG. 4, device 10 may include control circuitry 42. Control circuitry 42 may include storage such as flash memory, hard disk drive memory, solid state storage devices, other nonvolatile memory, random-access memory and other volatile memory, etc. Control circuitry 42 may also include processing circuitry. The processing circuitry of control circuitry 42 may include digital signal processors, microcontrollers, application specific integrated circuits, microprocessors, power management unit (PMU) circuits, and processing circuitry that is part of other types of Integrated circuits.

Circuitry 42 may include input-output devices such as displays, speakers, microphones, status indicator light-emitting diodes, sensors such as proximity sensors and accelerometers, touch screens, data port circuits coupled to data ports, analog input-output circuits coupled to audio connectors and other analog signal ports, track pads and other pointing devices, etc.

Wireless communications circuitry such as radio-frequency transceiver circuitry 44 may be used in transmitting and receiving radio-frequency signals. Circuitry 44 may be used to handle one or more communications bands. Examples of communications bands that may be handled by circuitry 44 include cellular telephone bands, satellite navigation bands (e.g., the Global Positioning System band at 1575 MHz), bands for short range links such as the Bluetooth® band at 2.4 GHz and wireless local area network (WLAN) bands such as the IEEE 802.11 band at 2.4 GHz and the IEEE 802.11 band at 5 GHz, etc.

Paths such as path 48 may include one or more radio-frequency transmission lines. Transmission lines in path 48 may include coaxial cable paths, microstrip transmission lines, stripline transmission lines, edge-coupled microstrip transmission lines, edge-coupled stripline transmission lines, transmission lines formed from combinations of transmission lines of these types, etc.

Transmission line path 48 may be used to couple radio-frequency transceiver circuitry 44 to one or more antennas 45. Antenna structures in antennas 45 may receive incoming radio-frequency signals that are routed to radio-frequency transceiver circuitry 44 by path 48. During signal transmission operations, radio-frequency transceiver circuitry 44 may transmit radio-frequency signals that are conveyed by path 48 to antenna structures 46 and transmitted to remote receivers.

Device housings such as housings 12 of FIGS. 1, 2, and 3, often contain conductive structures such as portions of display 14 and portions of housing 12. Some of these structures (e.g., parts of metal housing walls in housing 12 or other structural device members) may sometimes be used in forming antennas for device 10 and may therefore be considered to form part of antennas 46 of FIG. 4. For example, parts of a metal housing (e.g., parts of housings 12 of FIGS. 1, 2, and 3) may form some or all of an antenna ground element for antenna(s) 46.

Antennas 46 may also contain antenna resonating element structures that work with the antenna ground elements. Antenna resonating element structures for antennas 46 may be formed from patterned metal foil, wires, parts of conductive housing structures or other conductive structures. With one suitable arrangement, antenna resonating element structures for antennas 46 are formed from conductive traces on substrates such as rigid printed circuit boards and flex circuits (i.e., printed circuits formed from patterned traces on thin sheets of flexible polymers such as polyimide).

In devices that contain conductive structures such as conductive housing structures, conductive display structures, and other conductive components that may interfere with radio-frequency signals, it may be desirable to mount some or all of the structures that make up antennas 46 under an inactive display region or other such dielectric structure. For example, it may be desirable to locate an antenna resonating element that is formed from patterned traces on a substrate on the inner surface of a display cover glass member or a dielectric housing plate.

Figure 5:
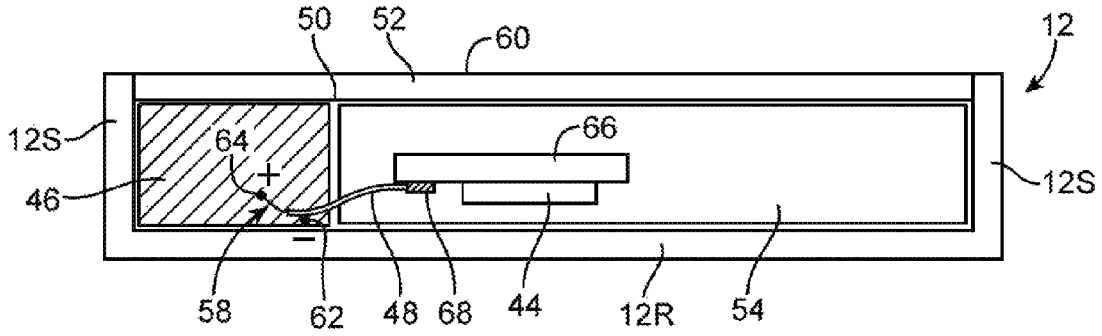
FIG. 5 is a cross-sectional diagram of an electronic device in accordance with an embodiment of the present invention.

As shown in the cross-sectional diagram of FIG. 5, device 10 may have antenna structures 46 that are mounted adjacent to inner surface 50 of dielectric structure 52. Dielectric structure 52 may be a planar member having an upper (exterior) surface (surface 60) that is parallel to inner surface 50. The thickness of structure 52 (i.e., the vertical distance between inner surface 50 and outer surface 60) may be less than 5 mm, less than 3 mm, less than 1 mm, less than 0.5 mm, or less than 0.3 mm (as examples). Structure 52 may be formed from glass, ceramic, fiber composites, plastic, other materials, or combinations of these materials.

With one suitable arrangement, structure 52 may form a planar structure such as a rectangular dielectric plate. The plate may serve as a cover for a display, as a housing structure, etc. As shown in FIG. 5, for example, structure 52 may serve to cover the front face of device 10, whereas housing portion 12R may form a substantially planar rear housing structure. Housing sidewalls 12S and housing structure 12R may be integral portions of housing 12. Antenna structures 46 and internal device components 54 may be mounted within housing 12. In configurations in which sidewalls 12S and structure 12R form part of an integral housing, sidewalls 12S may be curved. Housing sidewalls 12S and structure 12R may also be formed from separate structures. For example, housing structure 12R may be a rectangular planar member and housing sidewalls 12S may be formed from a metal peripheral housing band that surrounds rectangular structure 52.

Internal components 54 may include printed circuit boards, a battery, sensors, integrated circuits, display structures, touch sensor structures (e.g., for a touch screen display), discrete components (e.g., inductors, resistors, and capacitors), connectors for input-output ports, and other device circuitry.

Antenna structures 46 may include mounting and biasing structures, antenna resonating element structures such as conductive antenna traces on substrates such as printed, circuit boards, adhesive, etc. Radio-frequency transceiver 44 may be mounted on a support, such as printed circuit board 66. A connector such as connector 68 may be used to couple transmission line 48 to board 66. Transmission line 48 may be coupled to antenna feed 58.

Antenna feed 58 may have a positive antenna feed terminal such as antenna feed terminal 64 and a ground antenna feed terminal such as ground antenna feed terminal 62. Parts of housing 12 such as parts of rear housing structure 12R and/or portions of housing sidewalls 12S may form a ground element for antenna structures 46 (i.e., portions of housing 12 may be considered to form portions of antenna structures 46). Antenna ground terminal 62 may be electrically connected to the antenna ground element for antenna structures 46 (e.g., by connecting feed terminal 62 to housing 12 using conductive structures such as wires, metal screws or other fasteners, conductive support brackets, metal traces on printed circuit boards, metal traces on plastic supports and other substrates, conductive housing structures, etc.). Positive antenna feed terminal may be connected to an antenna resonating element that, in combination with the antenna ground element, forms an antenna for device 10.

Antenna structures 46 may contain one or more antennas that are fed using this type of configuration. For example, antenna structures 46 may contain one or more antenna resonating elements each of which is configured to operate in a different respective communications band. Antenna structures 46 may also contain one or more multiband antennas (i.e., one or more antennas that are each configured to operate at more than one different communications band).

Figure 6:
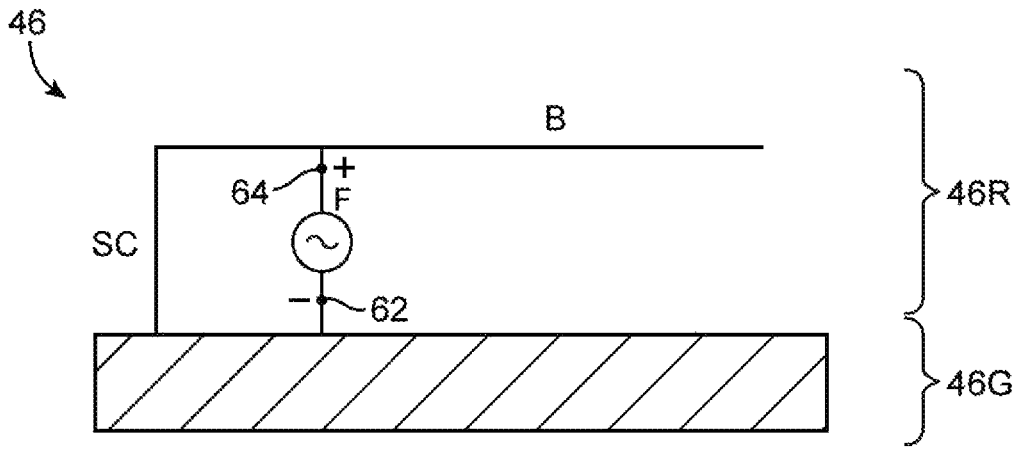
FIG. 6 is a diagram of an illustrative antenna that may be used in a wireless electronic device in accordance with an embodiment of the present invention.

The antenna or antennas formed by structures 46 may be monopoles, dipoles, planar inverted-F antennas, patch antennas, inverted-F antennas, loop; antennas, closed or open slot antennas, other antenna designs, or antennas that use hybrid arrangements incorporating one or more of these antennas. An illustrative inverted-F antenna of the type that may be used for structures 46 is shown in FIG. 6. As shown in FIG. 6, inverted-F antenna 46 may include a ground plane element 46G and an antenna resonating element (element 46R). Antenna resonating element 46R may have a main resonating element branch B, a short circuit branch SC, and a feed branch F. Antenna feed terminals 64 and 62 may be coupled in feed branch F. Antenna resonating element 46R may be formed from conductive structures such as patterned metal traces. The patterned metal traces may be formed on a substrate such as a single-layer or multilayer printed circuit board substrate, a plastic support structure, a ceramic substrate, a glass substrate, or other structures. Examples of printed circuits that may be used in forming antenna resonating element 46R include rigid printed circuit boards such as fiberglass filled epoxy boards (e.g., FR4), flex circuits (i.e., printed circuits formed from one or more laminated polymer layers such as sheets of polyimide that are connected using interposed layers of adhesive), and rigid flex (e.g., boards that include both rigid and flexible regions).

Figure 7:
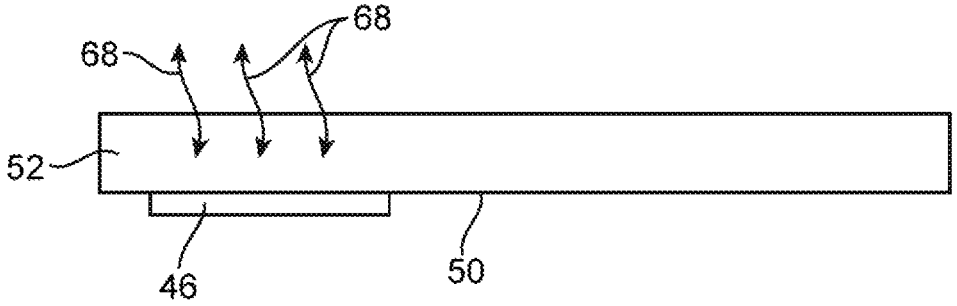
FIG. 7 is a cross-sectional side view of an antenna mounted adjacent to a planar dielectric layer in an electronic device in accordance with an embodiment of the present invention.
Figure 8:
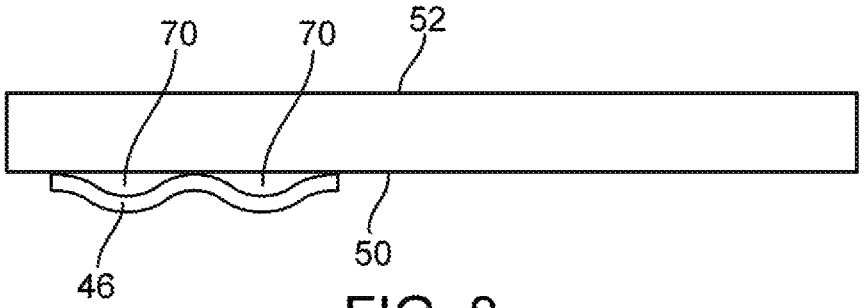
FIG. 8 is a cross-sectional side view of the antenna of FIG. 7 snowing how there is a potential for air gaps to form between portions of the antenna and the planar dielectric layer if care is not taken when mounting the antenna.

As shown in the cross-sectional side view of FIG. 7, antenna structures 46 may be mounted against inner surface 50 of dielectric structures 52. In this configuration, radio-frequency antenna signals 68 may be transmitted and received through structures 52. As shown in FIG. 8, there is a potential for structures 46 that are loosely secured to separate from surface 50. For example, some or all of structures 46 may separate sufficiently from surface 50 to give rise to air gaps such as air gaps 70.

Figure 9:
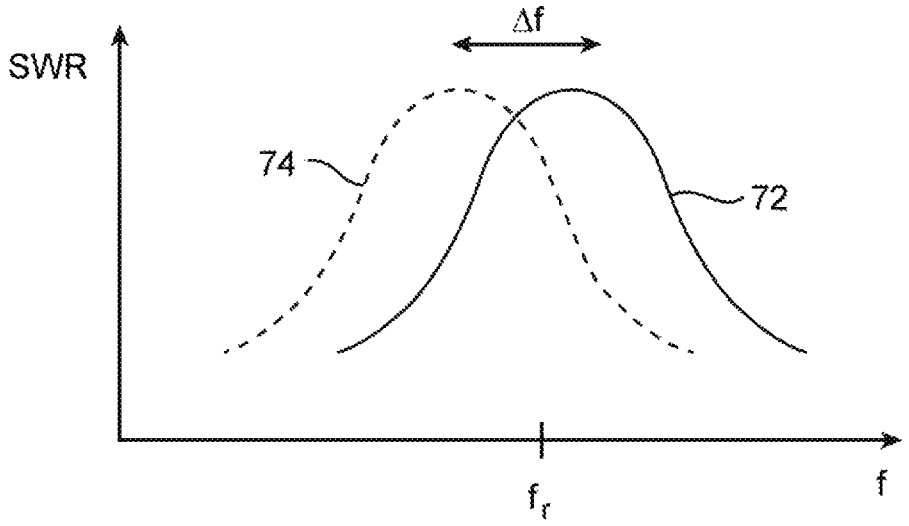
FIG. 9 is a graph snowing how the frequency response of an antenna such as the antenna of FIG. 7 may shift if gaps of the type shown in FIG. 8 develop during operation of an electronic device.

The presence of air gaps such as air gaps 70 may cause unpredictable changes in the impedance of antenna structures 46 that can undesirably influence the performance for antenna structures 46. Antenna structures 46 that are mounted directly against surface 50 of structures 52 in FIG. 7 may, for example, have an antenna resonance curve such as curve 72 of FIG. 9 that peaks at a frequency $f_r$. Frequency $f_r$ may coincide with the center frequency of a communications band of interest such as the center of a 2.4 GHz or 5 GHz IEEE 802.11 band (i.e., antenna structures 46 may function properly when mounted as shown in FIG. 7). If, however, gaps such as air gaps 70 of FIG. 8 develop between antenna structures 46 and surface 50 of structures 52, antenna structures 46 may be characterized by antenna resonance curve 74 of FIG. 9. As shown in FIG. 9, the frequency peak of curve 74 may be shifted significantly (e.g., by 50 MHz) from the peak of curve 72, because gaps 70 detune antenna structures 46. When mounted so that gaps such as gaps 70 can unexpectedly form between structures 46 and surface 50, antenna performance may be unpredictable.

To ensure that antenna performance in device 10 is predictable and does not change unexpectedly over time, antenna structures 46 may be mounted against surface 50 of structures 52 as shown in FIG. 7. Arrangements of the type shown in FIG. 10 may be used to ensure satisfactory mounting.

Figure 10:
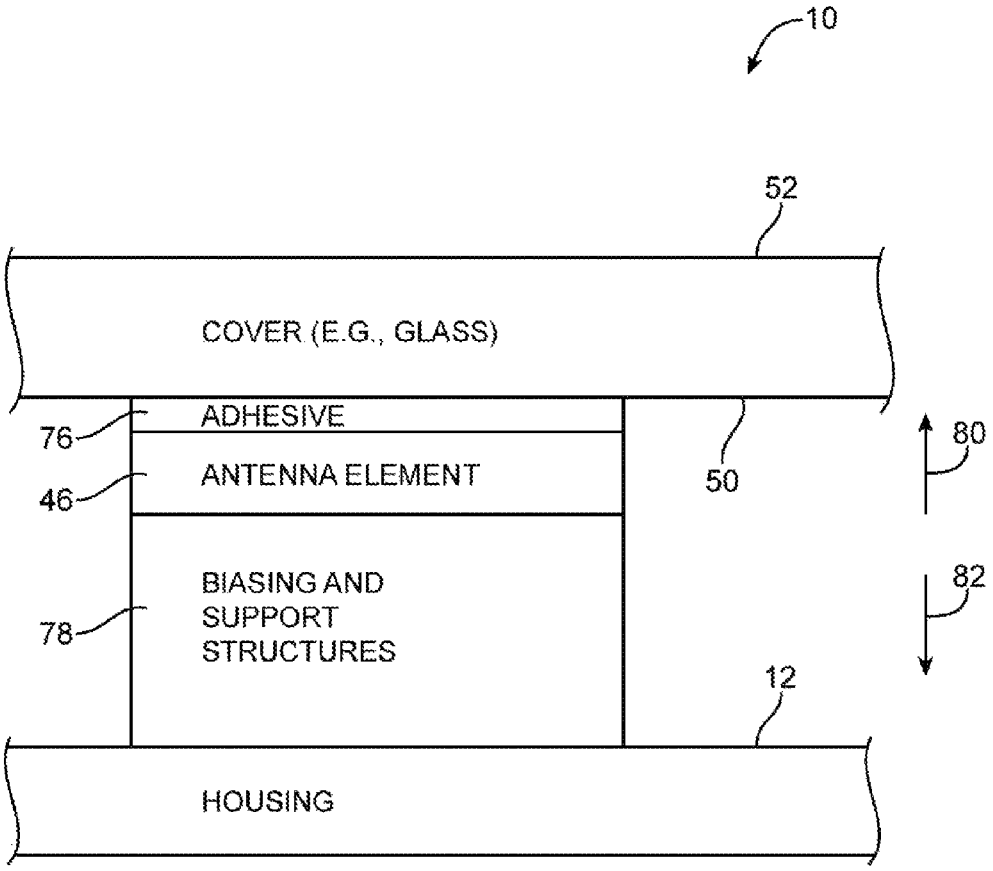
FIG. 10 is a cross-sectional side view of a portion of an electronic device showing how structures such as biasing and support structures may be used in mounting an antenna behind a planar dielectric structure in accordance with an embodiment of the present invention.

As shown in FIG. 10, antenna structures 46 (e.g., an antenna resonating element) may be mounted against surface 50 of structures 52 using adhesive 76. Adhesive 76 may be a pressure sensitive adhesive, a liquid adhesive such as epoxy, adhesive-coated tape, or other adhesives. Adhesive 76 may be cured by application of light (e.g., ultraviolet light), by raising the temperature of adhesive 76 (e.g., to over 100° to thermally cure adhesive 76), by using a two-part formulation for adhesive 76, etc.

Biasing and support structures 78 may include support members such as dielectric supports formed from rigid plastic, flexible plastic (e.g., soft plastic such as polytetrafluoroethylene), glass, ceramic, etc. Support members may be used, for example, to form a spacer that separates antenna resonating element 46 from housing 12 (which may form a ground element for the antenna). Biasing structures in structures 78 may include layers of foam, rubber, or other compressible substances, coil springs, leaf springs, other spring structures, etc. Biasing structures in structures 78 may be compressed between antenna resonating element 46 (e.g., the flex circuit or other substrate from which antenna resonating element 46 is formed) and housing 12 (or structures mounted on housing 12). When compressed in this way, the biasing structures can create a restoring force that presses downwards in direction 82 against housing 12 (or other underlying structures in device 10) and that presses upwards in direction 82. The upwards (outwards) pressure in direction 80 that is produced by support structures 78 helps press antenna resonating element 45 against adhesive 75, thereby helping to attach antenna resonating element 46 securely against lower (interior) surface 50.

Over time, the upwards force produced by the biasing structures in structures 78 may lessen (e.g., because the restoring force generated by the compressed foam or other biasing structure tends to weaken under continuous load). This effect will help lessen the likelihood that structures 52 will be undesirably forced out of device 10. Because adhesive 76 will preferably have formed a permanent adhesive bond by the time that the biasing force from structures 78 has faded, there will generally not be a risk of detachment between antenna resonating element 45 and surface 50.

In some assembly scenarios it may be possible to attach antenna resonating element 46 to surface 50 using adhesive 76 before structures 52 are mounted within housing 12. In some device architectures, however, it may be difficult or impossible to attach antenna resonating element 46 to surface 50 before structures 52 are mounted within housing 12. It may, for example, be desirable to form transmission line 43 (FIG. 5) from an integral portion of the same flex circuit (or other substrate) that is being used to form antenna resonating element 46. This type of arrangement may help minimize part count and may avoid interposing potentially unreliable radio-frequency interfaces between connector 68 on board 66 and antenna resonating element 46. If, however, transmission line 48 and antenna resonating element 46 are formed from a single piece of flex circuit material, antenna resonating element may become tethered to connector 58 during assembly. The finite length of the transmission line portion of the flex circuit, may not be sufficient to accommodate the amount of relative movement between structures 52 and housing 12 that would allow antenna resonating element 46 to be attached to surface 50 of structures 52 before structures 52 are inserted into housing 12.

Figure 11:
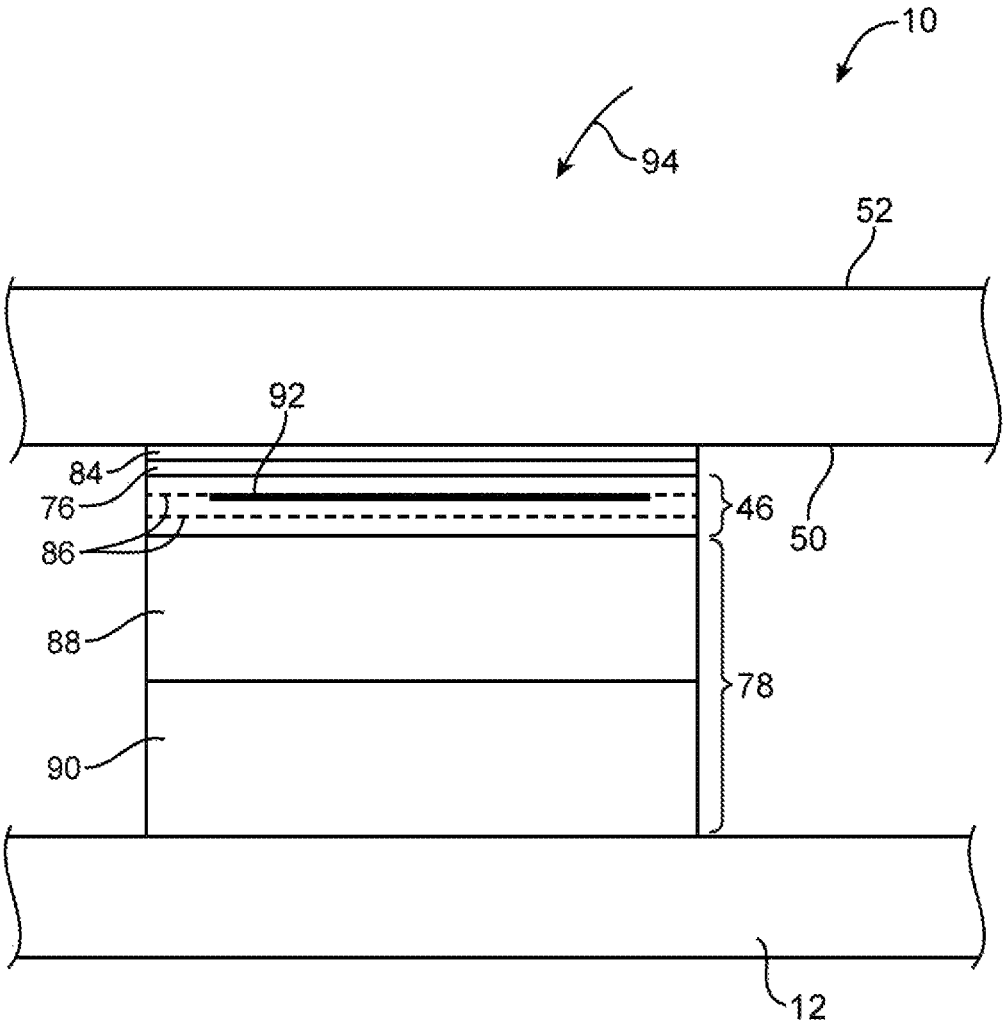
FIG. 11 is a cross-sectional side view of a portion of an electronic device showing how an antenna may be mounted behind a planar dielectric layer using a support structure on a device housing and a biasing structure such as a foam structure that is interposed between the support structure and the antenna in accordance with an embodiment of the present invention.

FIG. 11 is a cross-sectional side view of an illustrative mounting arrangement of the type that may be used to mount antenna resonating element 46 within device 10. Antenna resonating element 46 may be formed from a single layer substrate or a substrate that contains multiple layers such as a multilayer printed circuit board substrate (e.g., a flex circuit or rigid board). The presence of multiple layers in antenna resonating element 46 of FIG. 11 is indicated by dashed lines 86. One or more layers of patterned conductive traces such as traces 92 may be formed in the layers of the flex circuit. Conductive traces 92 may be formed from a metal such as copper (as an example).

Support structures 78 may contain one or more support structures such as structure 90 and one or more biasing structures such as compressible layer 88. Compressible layer 88 may be formed from a compressible material such as foam (as an example). Structure 90 may be formed from plastic or other suitable dielectric materials. As an example, structure 90 may be formed from a material such as polytetrafluoroethylene. Optional adhesive may be used to attach structure 90 to housing 12. Housing 12 may be formed from a conductive material such as metal (e.g., stainless steel, aluminum, etc.) and may form an antenna ground element that, in conjunction with antenna resonating element 46, forms an antenna for device 10.

Dielectric structures 52 may be formed from a glass plate or other planar dielectric member. For example, dielectric structure 52 may be a clear layer of cover glass that forms the outermost layer of display 14. In this type of arrangement, some of the cover glass layer will cover active display region 16 and will allow an image from underlying image pixels to be viewed and some of the cover glass layer (i.e., the portion that overlaps antenna resonating element 46) may be associated with inactive display region 20 (see, e.g., FIGS. 1, 2, and 3).

To hide antenna resonating element 46 from view in direction 94, a coating layer of opaque material such as coating 84 may be formed on interior surface 50 of structure 52. Coating 84, which may sometimes be referred to as an opaque masking layer, may be formed from a layer of black ink, a layer of ink having other suitable colors (e.g., white, blue, green, red, etc.), paint, polymer, or other suitable materials. If desired, the light-blocking functions of opaque masking layer 84 may be provided by incorporating opaque material into adhesive coating 76 (i.e., so that masking layer 84 may be omitted in favor of using only coating 76).

In a typical configuration, structure 52 may have a thickness of less than 1 mm (e.g., 0.8 mm) and may have a dielectric constant ($\in_r$) of 8-13. Opaque masking layer may have a thickness of less than 0.2 microns (as an example). Adhesive layer 76 may have a thickness of less than 60 μm (e.g., 40-50 μm) and a dielectric constant of 4-5. Antenna resonating element 45 may be formed from a substrate such as a polyimide flex circuit substrate having a thickness of less than 0.2 mm (e.g., about 0.1 mm) and a dielectric constant of about 3.5-4. Foam layer 88 may have a thickness of less than 2 mm (e.g., about 1.5 mm) and may have a dielectric constant of about 1.5 to 1.6. Support structure (sometimes referred to as a plastic carrier) may have a thickness of less than 5 mm (e.g., 3-4 mm) and may have a dielectric constant of about 2.2.

Figure 12:
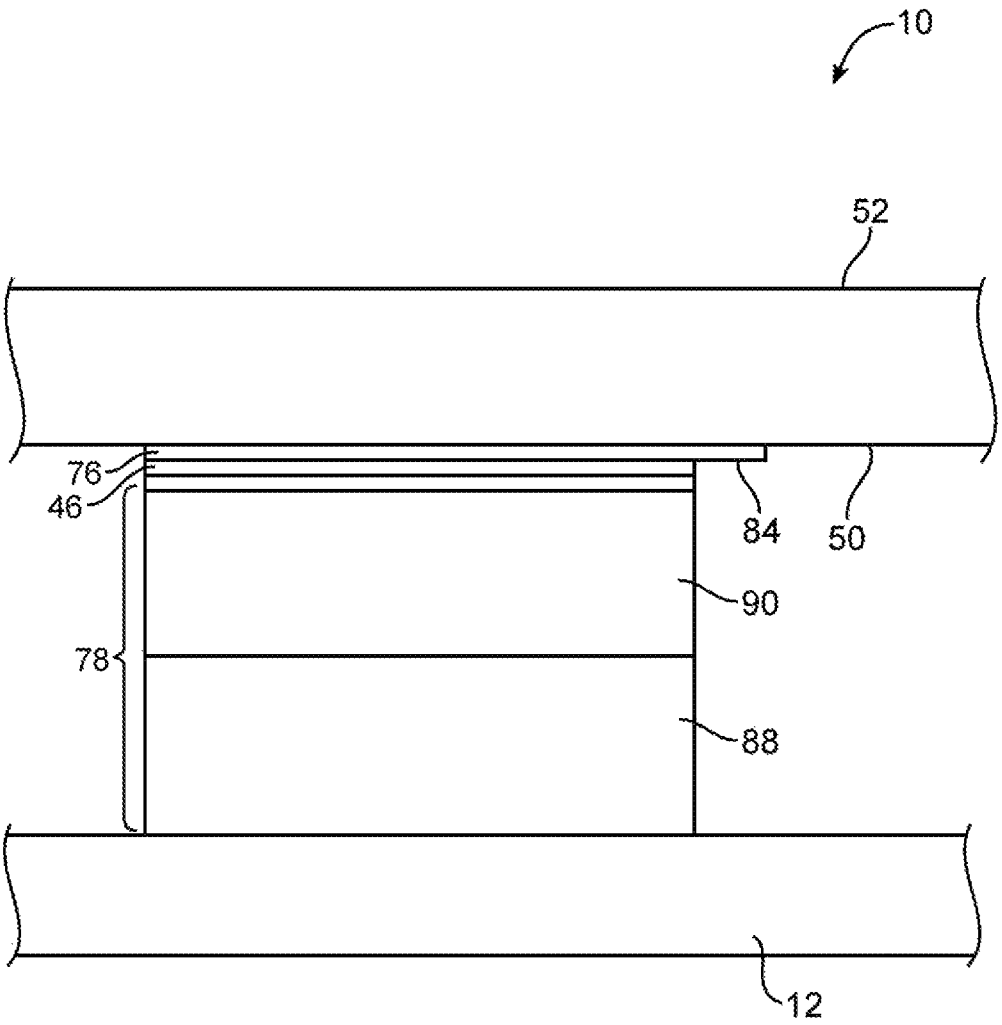
FIG. 12 is a cross-sectional side view of a portion of an electronic device showing how an antenna may be mounted behind a planar dielectric layer using a support structure that supports the antenna and using a biasing structure such as a foam structure that is interposed between the support structure and a device housing in accordance with an embodiment of the present invention.

FIG. 12 shows how the order of biasing structure (e.g., the layer of foam or other compressible material) and support structure 90 may be reversed. In the FIG. 12 arrangement, antenna resonating element 46 may rest on support structure 90 and support structure 90 may rest on biasing structure 88. Optional layers of adhesive may be used to secure biasing member 88 to support member 90, to secure support member 90 to antenna resonating element 46, and to secure biasing member 88 to housing 12.

Figure 13:
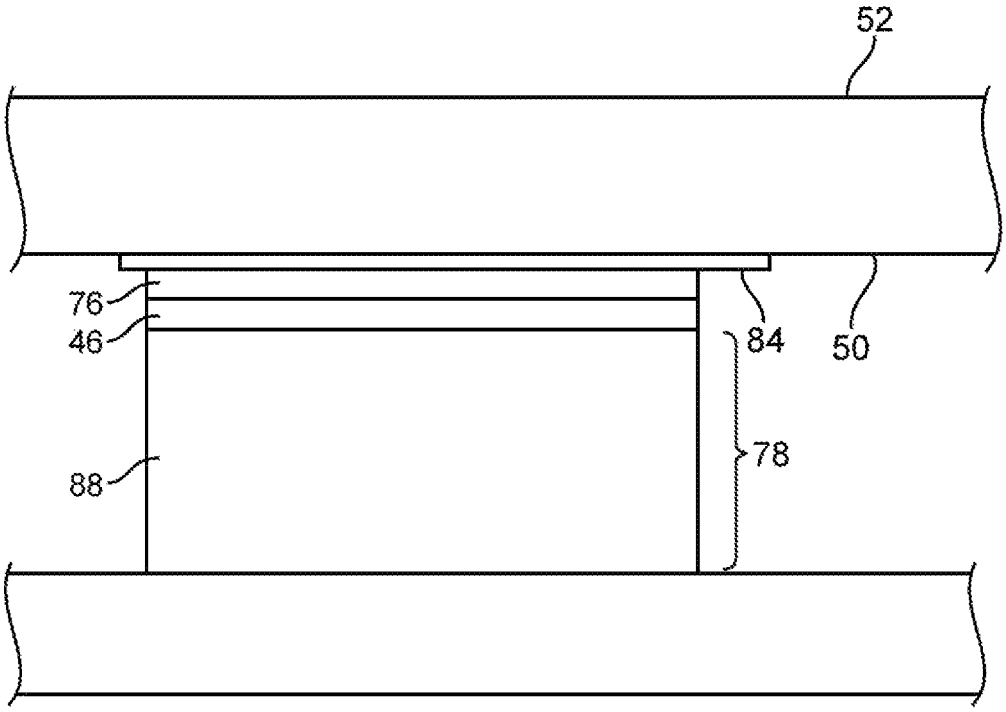
FIG. 13 is a cross-sectional side view of a portion of an electronic device showing how an antenna may be mounted behind a planar dielectric layer using a biasing structure such as a foam structure that is interposed between the antenna and a device housing in accordance with an embodiment of the present invention.

In the illustrative configuration of FIG. 13, biasing structures 78 contain little or no support structures and contain exclusively (or nearly exclusively) biasing structures 88. Biasing structures 88 may be formed from a layer of compressible material such as foam, an elastomeric material, etc. In this type of configuration, biasing structures 88 may serve to provide both supporting and biasing functions. When only foam is included between antenna resonating element 46 and housing structures 12 it may be desirable to limit the vertical spacing between antenna resonating element 46 and housing 12 to limit the propensity of this type of stacked arrangement to tip to the side. In arrangements of the type shown in FIGS. 11 and 12, support structures 90 are typically stiffer (more rigid) that compressible biasing member 88, which reduces the likelihood of tipping.

Figure 14:
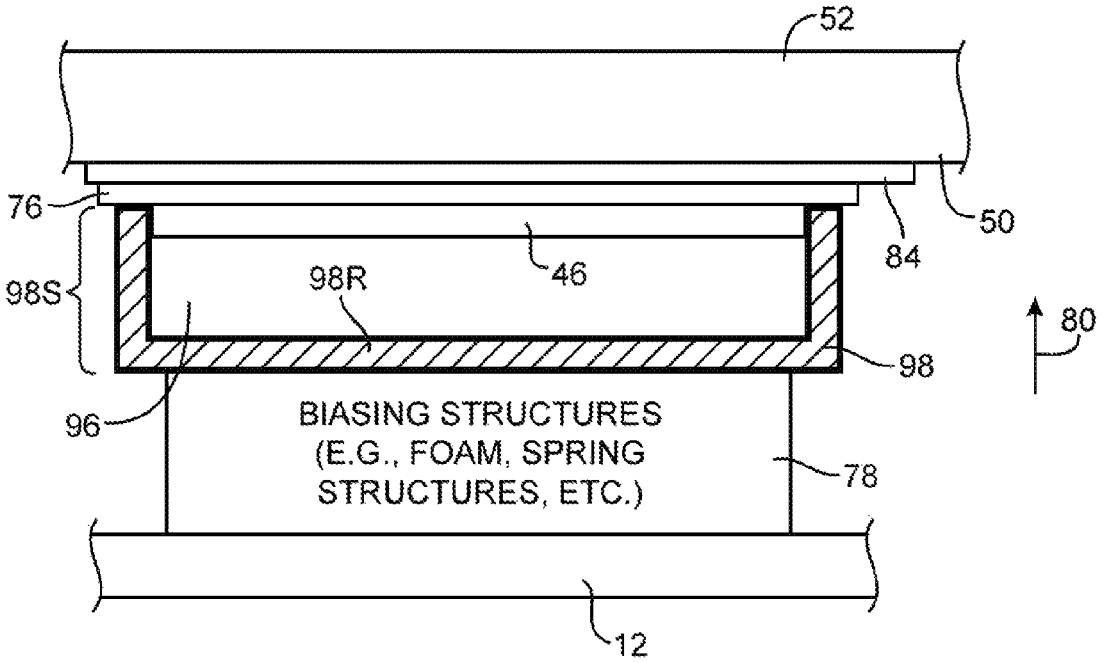
FIG. 14 is a cross-sectional side view of a portion of an electronic device showing how an antenna and a conductive cavity structure for the antenna may be mounted behind a planar dielectric layer using biasing structures that are interposed between the cavity structure and the antenna in accordance with an embodiment of the present invention.
Figure 15:
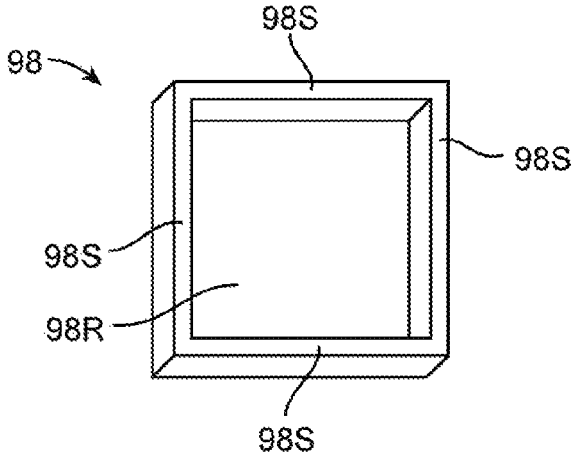
FIG. 15 is a perspective view of an illustrative conductive cavity structure that may be used for the antenna of FIG. 14 in accordance with an embodiment of the present invention.

If desired, one or more antennas in electronic device 10 may be implemented as cavity antennas. As shown in FIG. 14, for example, antenna resonating element 46 may be mounted in a cavity such as cavity 98. Cavity 98 may have sidewalls 98S and a rear cavity surface such as planar cavity surface 98L. As shown in FIG. 15, cavity 98 may have a rectangular shape. Other shapes may be used for cavity 98 if desired (e.g., circular, oval, shapes with curved and straight sidewalls when viewed from the top, shapes with depths (vertical dimensions) of varying magnitude, etc. Metal or other conductive materials may be used in forming the walls of cavity 98.

As shown in FIG. 14, cavity 98 may be biased in direction 80 towards structure 52 using biasing structures 78. Biasing structures 78 may be based on one or more layers of compressible material such as foam or elastomeric polymers, springs, or other biasing members. If desired, support structures (e.g., plastic, metal, etc.) may be included in structures 78. Integral portions of housing 12 may be used as supports, because close proximity between conductive portions of housing 12 and antenna resonating element 46 will not affect antenna performance in the FIG. 14 configuration, as cavity 98 surrounds and encloses antenna resonating element 46. To ensure that the spacing between lower cavity wall 98L and antenna resonating element 46 is well controlled so that antenna performance is within design specifications, the upper edges of walls 98S and antenna resonating element 46 may both be biased upwards in direction 80 against adhesive layer 76, optional opaque masking layer 84, and surface 50.

Figure 16:
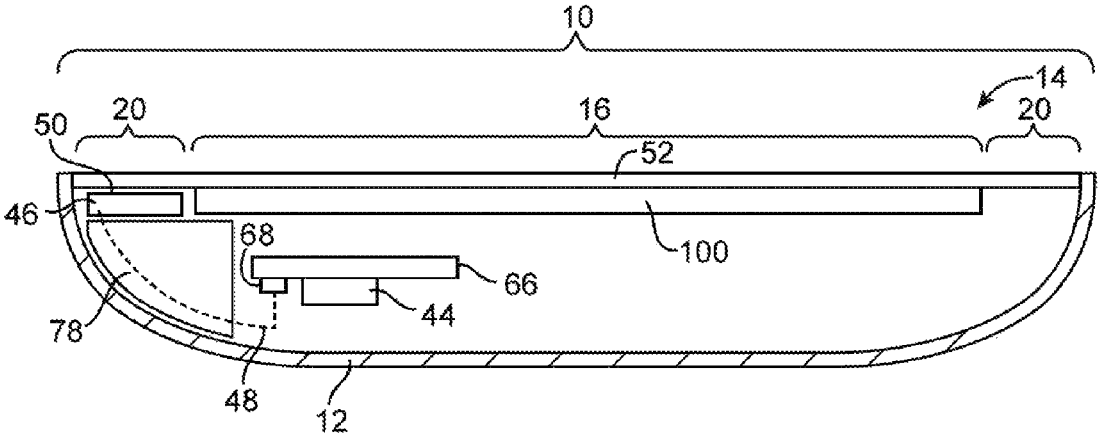
FIG. 16 is a cross-sectional side view of an illustrative electronic device in which an antenna has been mounted under a planar dielectric layer such as a planar transparent display cover glass layer with peripheral opaque masking layer regions in accordance with an embodiment of the present invention.

FIG. 16 is a cross-sectional side view of an illustrative configuration that may be used in mounting antenna resonating element 46 within device 10. As shown in FIG. 16, biasing and support structures 78 may be used to mount antenna resonating element 46 against the inner surface 50 of cover glass 52. Antenna resonating element 46 may be located under part of inactive display region 20 in display 14. Display module 100 (e.g., a liquid crystal display module with an optional integrated touch sensor array) may be formed under active region 16 of display 14. Radio-frequency transceiver 44 may be mounted to printed circuit board 66. Housing 12 may be formed from a conductive material such as metal and may form an antenna ground element. Antenna resonating element 46 and the ground antenna element formed from housing 12 may form an antenna for device 10. Transmission line 48 may be used to convey radio-frequency signals between radio-frequency transceiver 44 and the antenna. The transmission line may have a positive conductor that is electrically connected to a positive antenna feed terminal and a ground conductor that is electrically connected to a ground antenna feed terminal.

Figure 17:
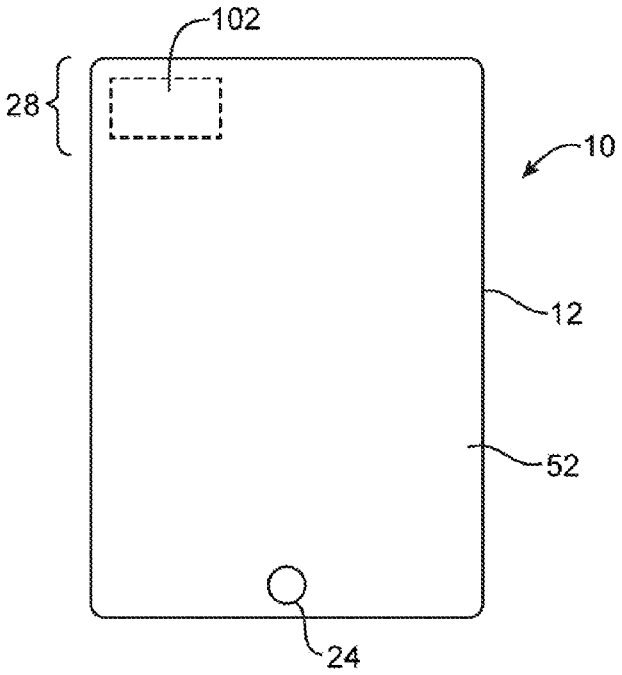
FIG. 17 is a top view of an electronic device of the type shown in FIG. 16 showing how the antenna may be mounted in one of the four corners of the device in accordance with an embodiment of the present invention.

FIG. 17 is a top view of electronic device 10 of FIG. 16 showing how the antenna formed from antenna resonating element 46 of FIG. 16 may be located in a region such as region 102. Region 102 may be located in a corner of device housing 12 (e.g., the upper left corner in the orientation of FIG. 17). This region may lie within upper end region 28 of device 10. Antennas may also be mounted under other portions of structure 52 (e.g., in other inactive display regions). If desired, structure 52 may form a rear plate for device 10 (e.g., a rear dielectric plate such as a rear glass plate, rear ceramic plate, etc.). In this type of configuration, antenna resonating element 46 may be mounted under portions of structure 52 such as portions at one of the ends of device 10 or in the center of the rear of device 10 (as examples).

Figure 18:
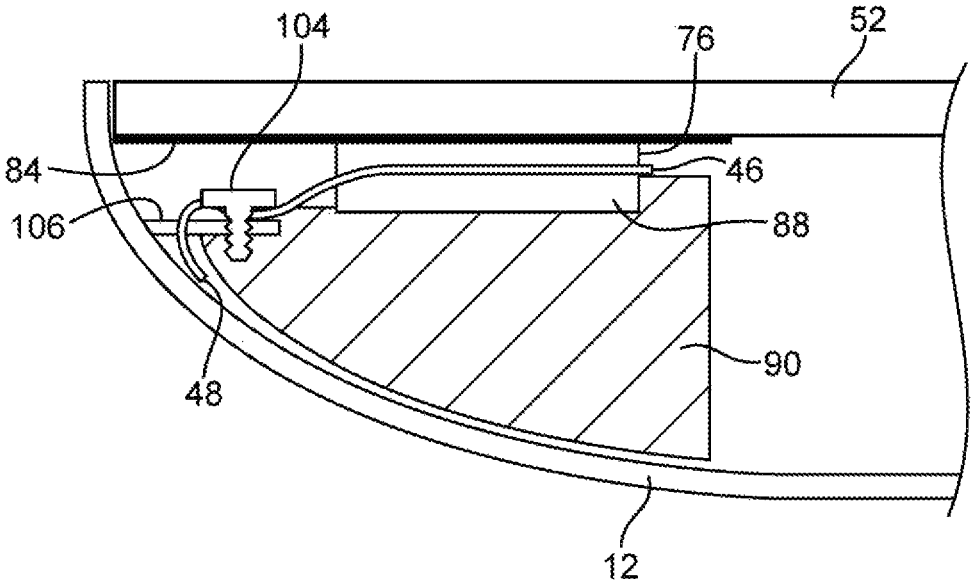
FIG. 18 is a cross-sectional side view of an antenna and associated structures in an electronic device having a planar dielectric layer such as a layer of display cover glass in accordance with an embodiment of the present invention.

FIG. 18 is a more detailed cross-sectional view of device 10 of FIG. 16 showing how support structure 90 may be mounted on housing 12. Antenna resonating element 46 and transmission line 48 may be formed as integral parts of a common flex circuit. Biasing layer 88 may be interposed between support structure 90 and antenna, resonating element 46. Adhesive 76 may be used to attach antenna resonating element 46 to structure 52 (which may be coated with an optional layer of opaque masking material such as layer 84). A support structure such as metal bracket 106 or other conductive structure may be electrically (and, if desired, mechanically) connected to housing 12. A conductive screw such as metal screw 104 may be used, to short conductive ground traces on the flex circuit that contains element 46 and transmission line 48 to bracket 106. This grounds the flex circuit ground traces to housing 12, which forms an antenna ground element. Transmission line 48 may extend continuously from antenna resonating element 46 to connector 68 on board 66 and thereby to transceiver 44, as indicated by dashed line 48 in FIG. 16.

Figure 19:
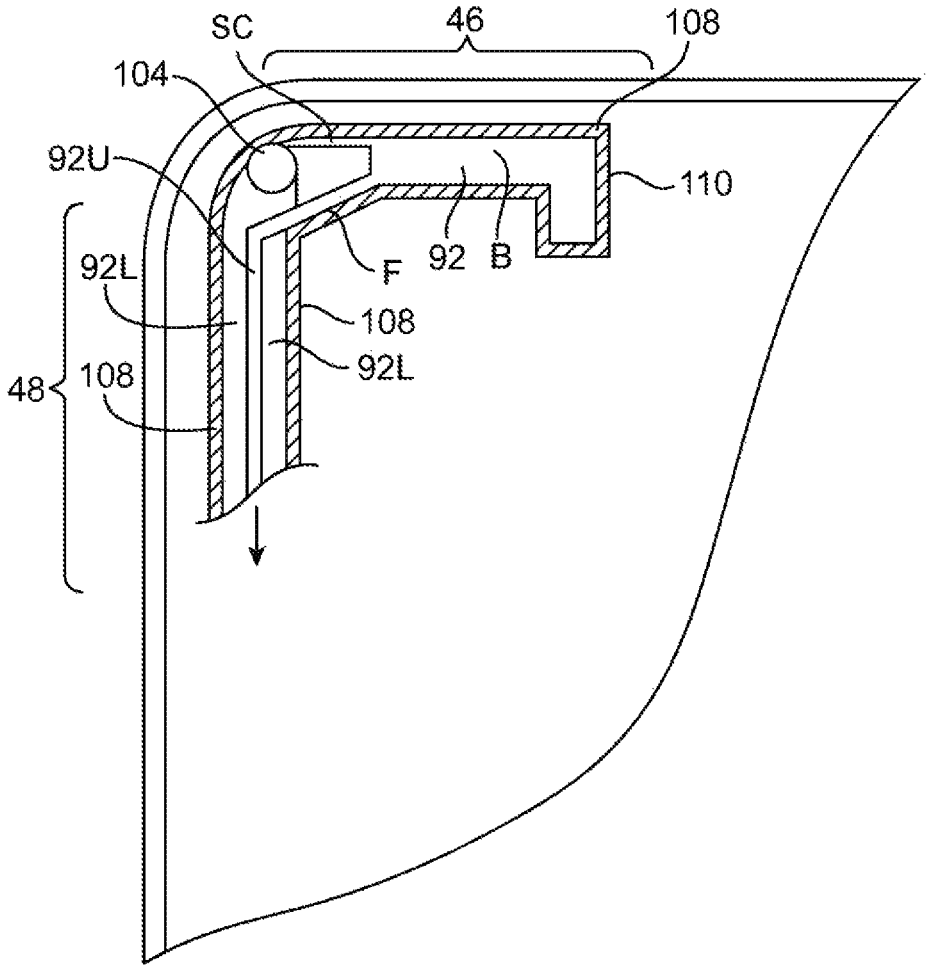
FIG. 19 is a top view of the antenna an associated structures of FIG. 18 in accordance with an embodiment of the present invention.

A flex circuit of the type that may be used to form antenna resonating element 46 and transmission line 48 (i.e., flex circuit 110) is shown in the top view of FIG. 19. As shown in FIG. 19, flex circuit 110 may have dielectric layers such as polyimide layers 108. Conductive traces such as traces 92 may be formed in one or more layers of flex circuit 110. In antenna resonating element portion 46 of flex circuit 110, traces 92 form main branch B of an inverted-F antenna such as the antenna of FIG. 6. Feed path F and short circuit path SC are also formed from portions of traces 92, as shown in FIG. 19. In transmission line region 48, one part of traces 92 (upper trace 92L) runs on top of another part of traces 92 (lower trace 92U). A layer of polyimide flex circuit material separates traces 92L and 92U to form a microstrip transmission line. Trace 92L may serve as the ground, conductor and trace 92U may serve as the positive conductor in microstrip transmission line 48. If desired, one or more upper layers of polyimide in flex circuit 110 may cover traces 92 in antenna resonating element 46 and transmission line 48. In the vicinity of screw 104, a ring-shaped portion of traces 92 is exposed and forms an electrical connection with the lower surface of the head of screw 104. Screw 104 screws into grounded bracket 106 (FIG. 18), thereby grounding traces 92 at screw 104 to antenna ground.

Figure 20:
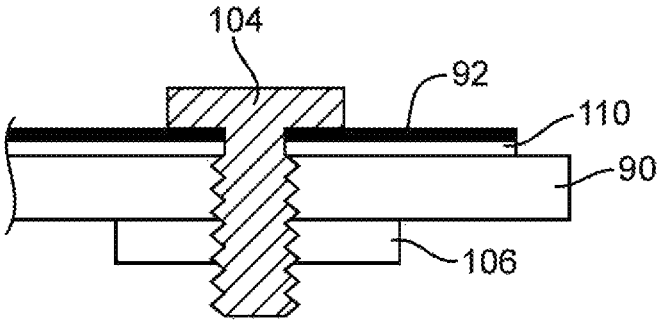
FIG. 20 is a cross-sectional side view of illustrative structures that may be used in mounting and grounding an antenna of the type shown in FIGS. 18 and 19 in accordance with an embodiment of the present invention.

FIG. 20 snows how screw 104 may be shorted to an exposed portion of traces 92 on flex circuit 110. Bracket 106 may have a threaded bore that receives mating threads on the shaft of screw 104, thereby shorting bracket 106 and screw 104 together. Some of carrier 90 may be interposed between flex circuit 110 and bracket 106 to support flex circuit 110 and bracket 106 within the interior of housing and device 10.

The foregoing is merely illustrative of the principles of this invention and various modifications can be made by those skilled in the art without departing from the scope and spirit of the invention.

What is claimed is:

1. An electronic device, comprising: a display having a display cover layer with an inner surface;

a flexible printed circuit substrate;

an inverted-F antenna having an antenna resonating element formed on a surface of the flexible printed circuit substrate;

a biasing structure that biases the flexible printed circuit substrate and the antenna resonating element against the inner surface of the display cover layer;

a housing having a housing surface that runs parallel to the display cover layer;

and a support structure, wherein the biasing structure is interposed between the housing surface and the support structure.

2. The electronic device defined in claim 1 further comprising: an opaque masking material on the inner surface of the display cover layer, wherein the opaque masking material is interposed between the flexible printed circuit substrate and the display cover layer.

3. The electronic device defined in claim 1 wherein the biasing structure comprises a layer of foam having first and second opposing surfaces, wherein the first surface is in contact with the housing surface and wherein the second surface is in contact with the support structure.

4. The electronic device defined in claim 3 wherein the support structure has opposing first and second surfaces, wherein the first surface of the support structure is in contact with the second surface of the layer of foam, and wherein the second surface of the support structure is in contact with the flexible printed circuit substrate.

5. The electronic device defined in claim 1 wherein the housing comprises a conductive material and has a portion that forms an antenna ground element for the inverted-F antenna.

6. The electronic device defined in claim 5 further comprising a positive antenna feed terminal coupled to the antenna resonating element and a ground antenna feed terminal coupled to the housing.

7. The electronic device defined in claim 1 further comprising a layer of adhesive interposed between the flexible printed circuit substrate and the display cover layer that attaches the flexible printed circuit substrate to the display cover layer.

8. The electronic device defined in claim 1 wherein the display cover layer comprises glass.

9. An electronic device, comprising:

a planar glass display layer having an inner surface;

a flexible printed circuit substrate;

an inverted-F antenna having an antenna resonating element formed on a surface of the flexible printed circuit substrate;

a housing having a housing surface that runs parallel to the planar glass display layer; and a layer of foam that biases the antenna resonating element against the inner surface of the planar glass display layer, wherein the layer of foam has first and second opposing surfaces, wherein the first surface is in contact with the flexible printed circuit substrate, and wherein the second surface is in contact with the housing surface.

10. An electronic device, comprising:

a display having a planar dielectric member with four edges and having an active region in which images are displayed and an inactive region that borders the active region;

an inverted-F antenna comprising an antenna resonating element mounted in the inactive region;

a dielectric carrier in the inactive region that supports the inverted-F antenna, wherein the inverted-F antenna is interposed between the dielectric carrier and the planar dielectric member, wherein the inverted-F antenna and the dielectric carrier extend along at least one edge of the planar dielectric member without extending along at least two other edges of the planar dielectric member;

a conductive housing in which the display, the inverted-F antenna, and the dielectric carrier are mounted; and a fastener that extends through the dielectric carrier to attach the dielectric carrier to the conductive housing.

11. The electronic device defined in claim 10 further, wherein the conductive housing comprises a portion that forms an antenna ground element, and wherein the antenna ground element forms part of the antenna.

12. The electronic device defined in claim 11 further comprising a positive antenna feed terminal coupled to the antenna resonating element and a ground antenna feed terminal coupled to the conductive housing.

13. The electronic device defined in claim 12 further comprising: a radio-frequency transceiver; and a transmission line that is coupled between the radio-frequency transceiver and the positive and ground antenna feed terminals.

14. The electronic device defined in claim 13 further comprising a flexible dielectric substrate having at least one flexible polymer sheet and conductive traces, wherein the transmission line comprises portions of the flexible dielectric substrate.

* * * * *